US009468803B2

(12) United States Patent
Tani

(10) Patent No.: US 9,468,803 B2
(45) Date of Patent: Oct. 18, 2016

(54) TRAINING LADDER

(71) Applicant: Shinichiro Tani, Kai (JP)

(72) Inventor: Shinichiro Tani, Kai (JP)

( * ) Notice: Subject to any disclaimer, the term of this patent is extended or adjusted under 35 U.S.C. 154(b) by 0 days.

(21) Appl. No.: 14/384,074

(22) PCT Filed: Feb. 15, 2013

(86) PCT No.: PCT/JP2013/053654
§ 371 (c)(1),
(2) Date: Sep. 9, 2014

(87) PCT Pub. No.: WO2013/132989
PCT Pub. Date: Sep. 12, 2013

(65) Prior Publication Data

US 2015/0045187 A1 Feb. 12, 2015

(30) Foreign Application Priority Data

Mar. 9, 2012 (JP) ..... 2012-053178

(51) Int. Cl.
*A63B 26/00* (2006.01)
*A63B 23/04* (2006.01)
(Continued)

(52) U.S. Cl.
CPC ..... *A63B 23/04* (2013.01); *A63B 17/00* (2013.01); *A63B 23/0458* (2013.01); *A63B 2071/0694* (2013.01); *A63B 2210/50* (2013.01)

(58) Field of Classification Search
CPC ..... A63K 3/00; A63B 71/00; A63B 69/00; A63B 67/00; A63B 23/0458; A63B 17/00; A63B 17/02; A63B 17/04; A63B 2210/50; A63B 2210/52; A63B 2210/54; A63B 29/00; A63B 29/02; A63B 23/04; A63B 23/0464; A63B 21/0004
USPC ..... 482/23; 182/196–198; 473/414, 415, 473/438, 440; 434/247, 251, 255, 258; 273/440, 441, 444
See application file for complete search history.

(56) References Cited

U.S. PATENT DOCUMENTS 2,317,193 A * 4/1943 Hopp ..... B63B 27/146 182/198
2,343,123 A * 2/1944 Dahlander ..... B63B 27/14 182/198

(Continued)

FOREIGN PATENT DOCUMENTS

| | | |
|---|---|---|
| DE | 3502127 A1 | 7/1986 |
| JP | 3034981 U | 3/1997 |
| JP | 3109885 U | 6/2005 |

OTHER PUBLICATIONS

PCT, "International Search Report for International Application No. PCT/JP2013/053654".

(Continued)

*Primary Examiner* — Oren Ginsberg
*Assistant Examiner* — Gregory Winter
(74) *Attorney, Agent, or Firm* — Manabu Kanesaka

(57) ABSTRACT

A training ladder has a first chain and a second chain arranged parallel to each other, a plurality of strings arranged parallel to each other and disposed between the first and second chains, and a plurality of hollow bars made of a rigid material turnably disposed over each of the plurality of strings. The plurality of hollow bars is arranged to have a play for absorbing a change of a joint direction of the bar and the chain at each of joint portions of the bars and the chains by turning the bar.

5 Claims, 8 Drawing Sheets

(51) Int. Cl.
*A63B 17/00* (2006.01)
*A63B 71/06* (2006.01)

(56) References Cited

U.S. PATENT DOCUMENTS 2,378,914 A * 6/1945 Dahlander ..... B63B 27/14 182/199
2,397,950 A * 4/1946 Dahlander ..... 182/196
2,397,953 A * 4/1946 Ellis ..... E06C 1/56 182/196
3,502,173 A * 3/1970 Arnold ..... E06C 1/12 182/211
3,809,181 A * 5/1974 Staranick ..... E06C 9/14 182/198
3,834,492 A * 9/1974 Ronk ..... E06C 1/56 182/196
3,874,375 A * 4/1975 Penner ..... A61H 1/0218 482/144
4,595,075 A * 6/1986 Rodrigue ..... E06C 9/14 182/198
6,955,631 B2 10/2005 Wu
7,461,501 B1 * 12/2008 Bajema ..... A01K 1/064 59/78
8,070,656 B2 12/2011 Dieter
2006/0229171 A1 10/2006 Severino

OTHER PUBLICATIONS

European Search Report, European Application No. 13758607.9-1658 dated Nov. 10, 2015.

* cited by examiner

TRAINING LADDER

RELATED APPLICATIONS

The present application is National Phase of International Application No. PCT/JP2013/053654 filed Feb. 15, 2013, and claims priority from Japanese Application No. 2012-053178, filed Mar. 9, 2012.

TECHNICAL FIELD

The present invention relates to a ladder-shaped training tool, or a training ladder, to be used for improving agility and the like of a body.

BACKGROUND ART

There is a so-called training ladder as a ladder-shaped training tool for improving speed, agility, and the like of a body, which has been developed in the United States, and, in Japan, has been familiarized from about 1990 by the Nippon Institute of Speed, Agility and Quickness specified non-profit corporation.

The training ladder is used as follows: the training ladder is laid on a place where training is to be performed, such as turf, artificial turf, and ground to step in a predetermined manner by using cells of the training ladder; in steps shown in FIG. 2(*a*), for example, right and left feet are positioned at R and L positions, respectively, and are moved forward in the cells in the order of arrows; in steps shown in FIG. 2(*b*), for example, right and left feet are positioned at R and L positions, respectively, and are moved transversely in the cells in the order of arrows; and speed, agility, and the like of a body are increased by stepping as above at a high speed.

CITATION LIST

Patent Literature

Patent Literature 1: Japanese Registered Utility Model No. 3109885

Patent Literature 2: Japanese Registered Utility Model No. 3034981

SUMMARY OF INVENTION

Technical Problem

Japanese Registered Utility Model No. 3109885 (Patent Literature 1) and Japanese Registered Utility Model No. 3034981 (Patent Literature 2) disclose preceding training ladders.

In Patent Literature 1, as shown in FIG. 8, ropes 16 are inserted into holes provided at both ends of each of plate-shaped members 15 to be attached to the plate-shaped members 15. In Patent Literature 2, members corresponding to the plate-shaped member and the rope described in Patent Literature 1 are both formed of belt-like strings that are not shown, and are attached to each other with an attaching and detaching fixture.

The training ladder is required to facilitate maintenance when becoming dirty and to reduce weight thereof for portability, as well as to prevent a user from getting injured when the user stumbles at the time of training. Accordingly, a soft resin (TPR), a synthetic rubber, and the like are used as a material of the training ladder. Unfortunately, there is a problem in which if a ground has severe unevenness to some extent, the training ladder may partially rise or incline by influence of the unevenness due to lightweight structure. In addition, since the training ladder is flexible, the whole of the training ladder is often twisted and twined at the time of storing it. If the training ladder is stored in a twisted state, a bend is easily created in the soft resin (TPR), or the synthetic rubber. The bend causes the training ladder to partially rise in many cases when the training ladder is placed on a ground regardless of unevenness of the ground.

When the training ladder is set, first the ladder twined is unwound and placing it on a ground is repeated many times while an entire twist is corrected. Thus, it is very difficult to set the training ladder. The setting as above is required when setting of the training ladder is disordered during training, so that it also takes time then. In addition, when the training ladder is removed after usage, it is required to adjust the training ladder so that a bend is not created therein at the time of storage after removal. Unfortunately, since the members are made of the soft material to cause the members to be twined with each other, an operation of adjusting the training ladder is very difficult.

Thus, a training ladder capable of being easily set and removed is required.

Training ladders that have currently become widespread are almost formed to have a 50 cm square on the basis of an assumption that adults use the training ladder. Thus, small training ladders available for training of children are required to become widespread. Although Patent Literature 2 describes a training ladder capable of changing a size of a cell, only a length in a longitudinal direction of the ladder is changed, whereby the cell is not a square. The training ladder is required to have a cell of a square to perform correct training because a user steps in a direction perpendicular to the longitudinal direction of the ladder as shown in FIG. 2(*b*).

Thus, there is required a training ladder having a small cell of a square corresponding to a user's height.

Solution to Problem

The problem above is solved by a training ladder including: a plurality of bars; and two chains one of which connecting one end of each of the plurality of bars to each other in order, the other of which connecting the other end of each of the plurality of bars to each other in the same order as that of the one ends, and in the training ladder, each of the bars is composed of a rigid body, and there is provided a play for resolving a change of a joint direction of the bar and the chain at each of joint portions of the bars and the chains.

The chain used at a position corresponding to that at which a rope is conventionally used allows the training ladder to be easily fitted into a setting place. That is, if a place to be used is a ground having unevenness, for example, the chain follows the unevenness to prevent the training ladder from rising, as well as, if a place to be used is turf or artificial turf, the turf passes through holes of the chain also to prevent the training ladder from rising. In addition, using the chain prevents the training ladder from being twisted at the time of storage. Although a material of the chain does not matter, it is preferable to use a light material such as a synthetic resin for weight-saving.

Forming the bar as a rigid body prevents the bar from being twisted or curled. In order to prevent a user's foot from getting injured if the foot collides with the bar during training, a surface of the bar may be coated with a soft material such as a synthetic resin and a rubber. In addition, unless the bar is twisted or curled, a synthetic resin or a rubber may be used as a material of the bar itself.

"A change of a joint direction of the bar and the chain" is that the joint direction of the bar and the chain is changed between a state where the training ladder is set on a ground and a state where the training ladder is removed, for example. In the state where the training ladder is set on a ground, the whole training ladder is on the same plane, and the bar and the chain are in contact with each other at an angle of about 90 degrees. In the state where the training ladder is removed, the bar is lifted, and then the chain is lifted by following rising of the bar. At the time, the joint direction of the chain and the bar is changed. In addition, a user may stumble on the ladder during training, and then the joint direction of the chain and the bar are changed.

"A play for resolving" means that there is looseness in a joint between the bar and the chain, and a change in a joint direction of the bar and the chain allows the bar to turn with respect to the chain, or the chain to turn with respect to the bar due to the looseness. As a result, the joint direction of the bar and the chain can be smoothly changed. Even if the joint direction of the bar and the chain is changed, the bar and the chain are not twisted or curled.

In addition, the problem above is solved by a training ladder including a cylindrical-shaped bar. Since the bar is formed into a cylindrical shape, it is unnecessary to consider a direction of setting the bar at the time of setting the training ladder for use, thereby facilitating the setting.

Further, the problem above is solved by a training ladder including a bar that is turnable with respect to a chain. Since the bar turns freely with respect to the chain, in a case where a user's foot is caught on the bar or the chain during training, movement caused by the caught foot is absorbed by turning the bar. As a result, it is possible to reduce a possibility that positions of the bar and the chain are displaced.

Furthermore, the problem above is solved by a training ladder in which a bar is hollow, and a string is provided at its both ends with a loop and extends through the hollow portion of the bar in a longitudinal direction of the bar, the loop being loosely linked with a ring constituting a chain. The training ladder is configured to use the string that can be independently moved from the bar, and to link the string with the chain. The string and the chain are configured to be loosely linked with each other, thereby forming the "play" described above. That is, when a user stumbles on the bar to cause the bar to be turned, for example, turning of the bar is not transmitted to the chain, so that the chain is not affected. As a result, a shape of the set ladder tends not to break.

Since the loop of the string and the ring of the chain are loosely linked with each other, the loop easily moves on the ring of the chain. Thus, when the bar is lifted at the time of removal, a linked portion of the loop and the ring moves from a side face of the ring to a curved portion at an upper portion of the ring. As a result, a change of a joint direction of the bar and the chain does not cause the bar and the chain to be twisted or curled.

The problem above is solved by a training ladder in which a bar is hollow, and a ring-shaped string extends through the hollow portion of the bar in a longitudinal direction of the bar, and also each of portions of the ring-shaped string positioned at both ends of the bar is put into a ring constituting a chain so that the string and the ring are linked with each other. A link of the bar and the chain, and a link of the ring-shaped string, are achieved only by "the string being put into the ring". Since the string itself can almost freely change its shape, a change of a joint direction of the bar and the chain is absorbed very easily.

In addition, the problem above is solved by a training ladder in which a bar of a plurality of bars, positioned at an end of the training ladder, is marked. Since the "a bar of a plurality of bars, positioned at an end of the training ladder" is a bar existing at each end of the training ladder, there are two corresponding bars. One of the two bars may be marked, or both of two bars may be marked. The term of "marked" means a state where the corresponding bars are distinguished from other bars. Thus, for example, a seal may be attached to the bars, and printing may be applied to the bars, and also a color different from that of the other bars is applied to the bars. As a result, since the bars positioned at both ends of the training ladder is distinguished from the other bars, the bars positioned at both ends can be easily found at the time of setting, thereby facilitating the setting.

Further, the problem above is solved by a training ladder in which one cell is a substantially square about 50 cm on each side. The cell of the substantially square on about 50 cm on each side is determined on the basis of an assumption that average adults use the training ladder. A numeric value of 50 cm is calculated from a step of average adults.

Furthermore, the problem above is solved by a training ladder in which one cell is a substantially square about 40 cm to 60 cm on each side. The cell of the square on about 40 cm on each side is determined on the basis of an assumption that elementary school students use the training ladder. A numeric value of "40 cm" is calculated from a step of average elementary school students. The cell of the square on about 60 cm on each side is determined on the basis of an assumption that persons 200 cm or more tall use the training ladder. A numeric value of "60 cm" is calculated from an average step of persons 200 cm or more tall.

Advantageous Effects of Invention

Since the training ladder in accordance with the present application is not twined and twisted, setting and removal of the training ladder are easy. The setting is completed by the following simple operation steps of: laying one of bars positioned at both ends in a longitudinal direction of the training ladder on a ground; advancing in a direction to which the training ladder is to be set while extending the training ladder in the direction in a state where the other of the bars is held with a hand; and laying the bar held with the hand on the ground when the training ladder is fully extended. The removal is completed only by collectively bundling the bars.

The training ladder in accordance with the present application can be manufactured by mainly using a pipe, a string, and a chain. Since lengths of the ladder in a longitudinal direction and in a direction perpendicular to the longitudinal direction are determined by a cutting position of the pipe, a length of the string, and an attachment position to the chain, a mold is unnecessary when a ladder with a cell of a different size is manufactured. In addition, it is unnecessary to stock bars of various sizes, and the like. As a result, it is easy to manufacture a training ladder having a small square cell.

DESCRIPTION OF EMBODIMENTS

Embodiments 1 to 3 will be described below.

Embodiment 1

Figure 1:
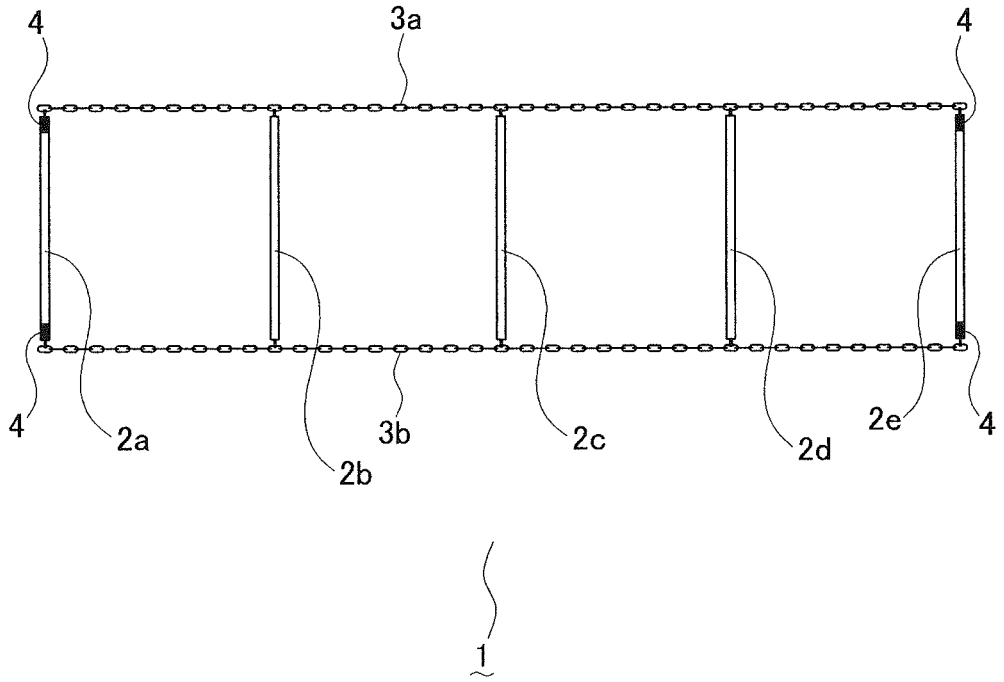
FIG. 1 shows a training ladder in accordance with the present application.
Figure 2A:
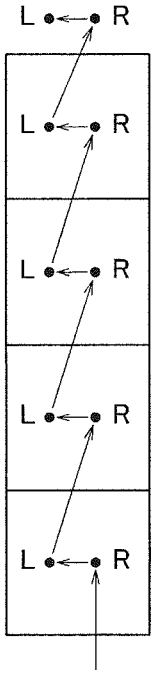
FIG. 2 shows examples of steps (*a*) and (*b*) of a training ladder.
Figure 2B:
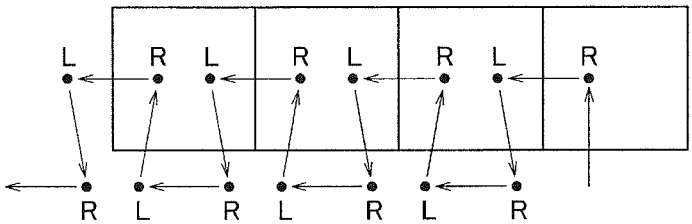

FIG. 1 shows a training ladder 1 in accordance with Embodiment 1. A training ladder 1 includes five bars (2*a*, 2*b*, 2*c*, 2*d*, and 2*e*), and two chains (3*a* and 3*b*). The chain 3*a* is attached to one end of each of the bars (2*a*, 2*b*, 2*c*, 2*d*, and 2*e*), and the chain 3*b* is attached to the other end of each of the bars (2*a*, 2*b*, 2*c*, 2*d*, and 2*e*), so that four square cells are formed.

Figure 3:
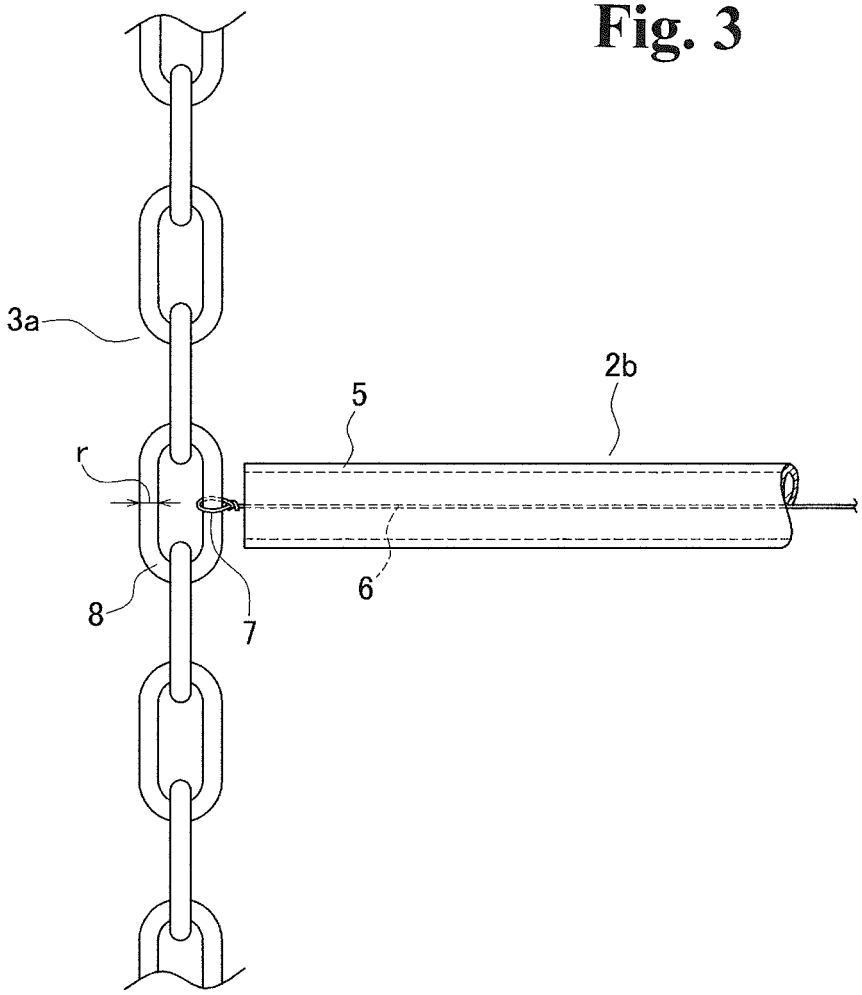
FIG. 3 shows a training ladder in accordance with Embodiment 1.

FIG. 3 shows a detail of an attachment portion of the bar 2*b* and the chain 3*a* in a state where the training ladder is set. The bar 2*b* is composed of a hollow pipe 5 and a strong nylon string 6. The string 6 is provided at its end with a loop 7, and one of rings 8, which is a unit constituting the chain 3*a*, is put into the loop 7. The loop 7 has a size a little larger than a diameter r of the ring 8, so that the ring can freely move in the loop. Although there is no illustration, the string 6 extends to the other end of the bar 2*b*, and is provided at its other end with a loop as well. One of rings, which is a unit constituting the chain 3*b*, is put into the loop. At the time of setting the training ladder, the chains extend almost linearly, so that the loop 7 is linked with a side of the ring (straight line portion). The string 6 can be freely moved in the pipe 5 because the loop 7 provided at each of both ends of the string 6 is only attached to the ring of the chain 3*a* or the ring of chain 3*b*.

Figure 4:
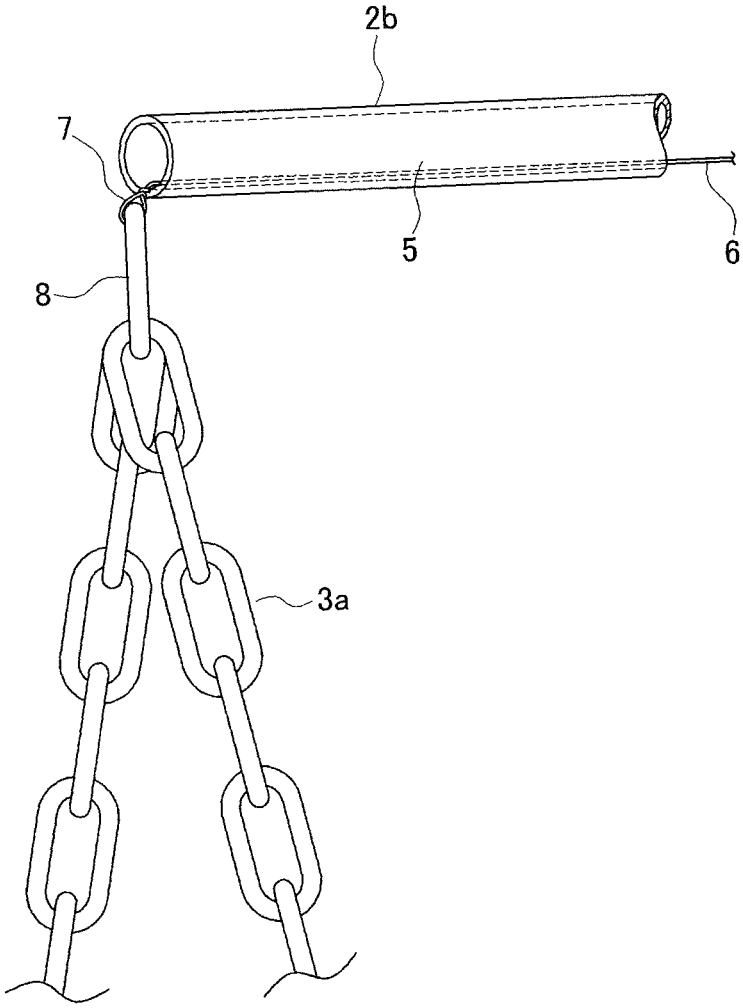
FIG. 4 shows the training ladder in accordance with Embodiment 1.

FIG. 4 shows an attachment portion of a bar and a chain in a state where the training ladder is being removed. At the time of removal, the bar 2*b* is lifted from a ground, so that rings in the chain other than a ring linked with the loop 7 suspend downward by self-weight. Accordingly, the ring linked with the loop 7 moves in the loop 7 to link with the loop 7 at an upper portion (curved portion) of the ring.

A tape 4 for a mark indicating bars provided at both ends is wound around each of the bars (2*a* and 2*e*) at both ends of five bars.

Figure 5:
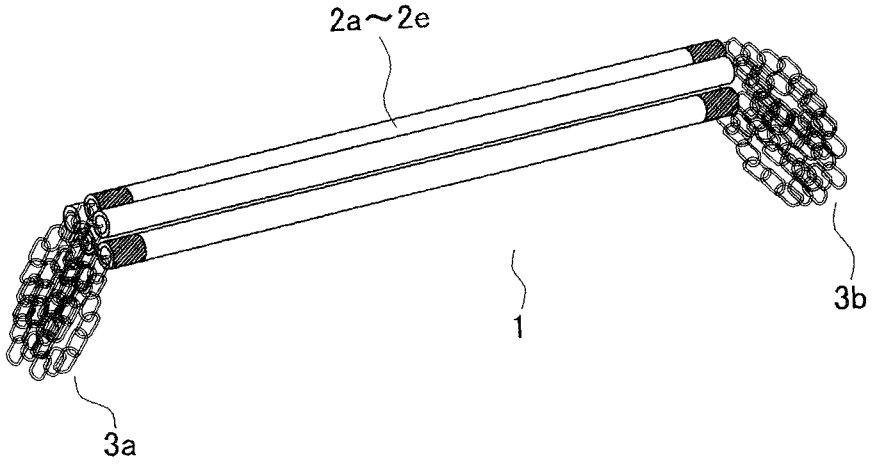
FIG. 5 shows a state of removal and storage of training ladders in accordance with Embodiments 1 to 3.

FIG. 5 shows a state where the training ladder is being removed and stored. At the time of storage, the bars are bundled. At the time of setting, end bars with the tape 4 are selected from the bundled bars, and then one end is laid on a ground and only the other end is pulled up, so that the training ladder easily extends linearly by self-weight, thereby allowing the training ladder to be set.

Embodiment 2

Figure 6:
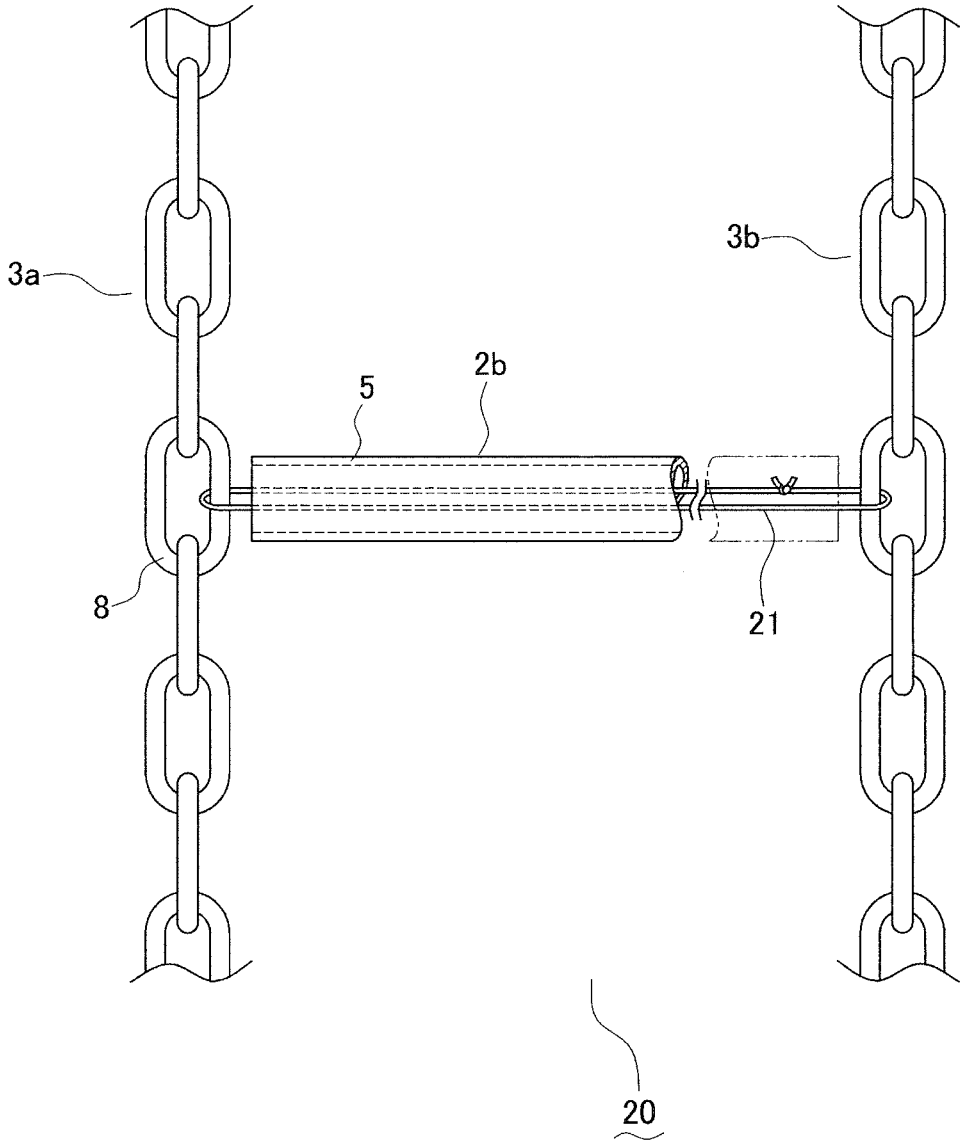
FIG. 6 shows a training ladder in accordance with Embodiment 2.

FIG. 6 shows an attachment portion of the bar 2*b* and the chain 3*a* in a state where a training ladder 20 in accordance with Embodiment 2 is set. The bar 2*b* is composed of a hollow pipe 5 and a strong nylon string 21. The whole of a string 21 is formed into a loop, and is stored in the pipe 5 over the whole length thereof. Both ends of the loop-shaped string project a little from both ends of the pipe 5, and each of the ends is put into a ring of the chains 3*a* or a ring of the chain 3*b*.

In Embodiment 2, the string 21 is put into the ring 8, so that the bar and the ring are not separated, and it is possible to easily change a joint direction of the bar and the ring.

Embodiment 3

Figure 7:
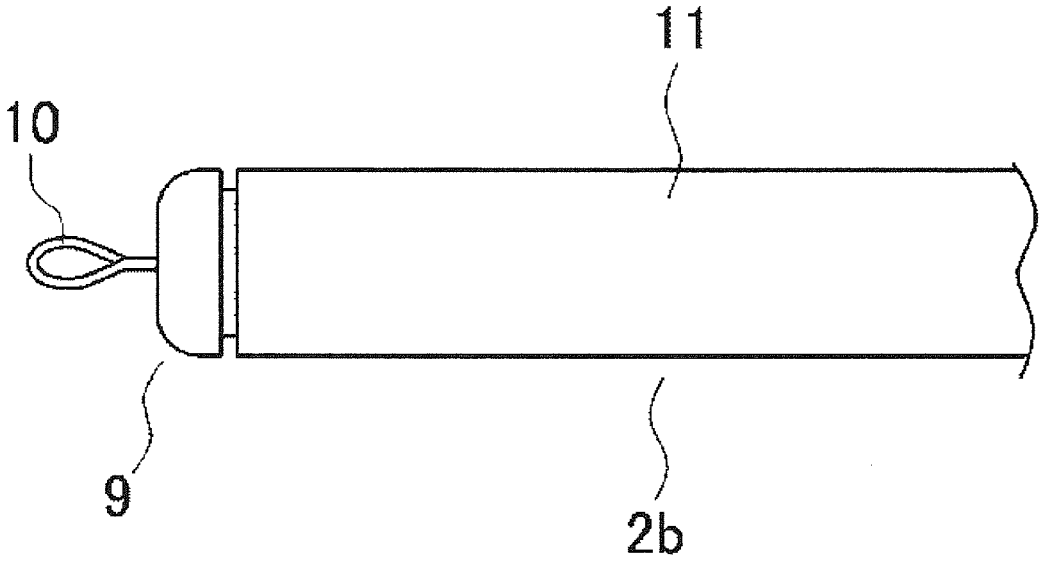
FIG. 7 shows a training ladder in accordance with Embodiment 3.
Figure 8:
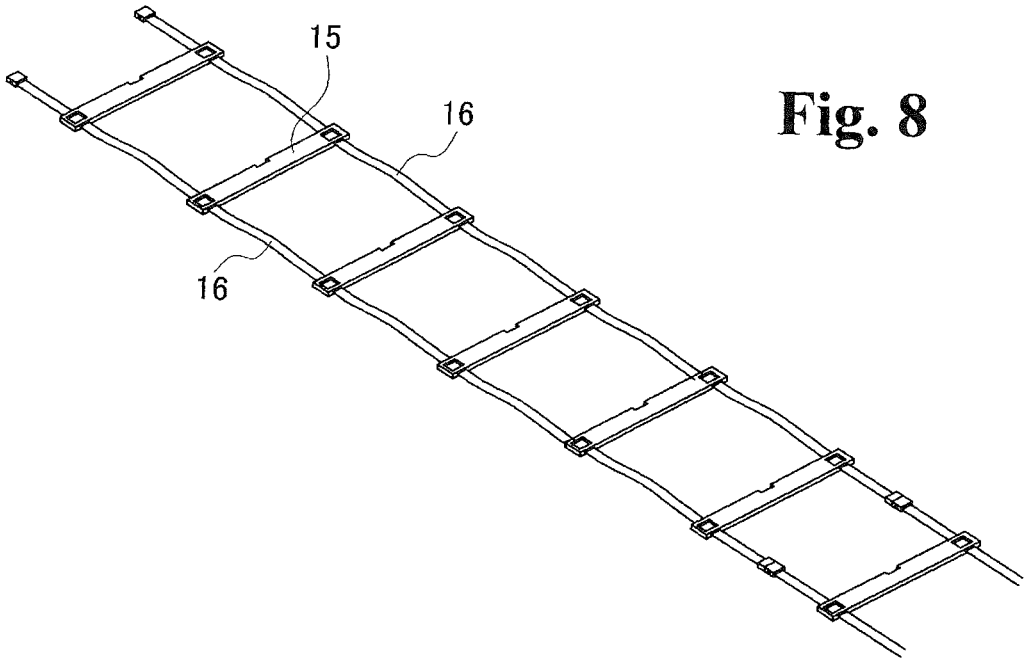
FIG. 8 shows a conventional training ladder.

FIG. 7 shows a training ladder in accordance with Embodiment 3. In Embodiment 3, a connector 9 is provided at an end of a bar. The connector 9 is attached to a body bar 11 in a rotatable manner, and a loop 10 is attached to the connector 9. Although there is no illustration, in Embodiment 3, a ring of a chain is put into a ring 8 as with Embodiment 1. Other structures are the same as those of Embodiment 1.

REFERENCE SIGNS LIST

1 training ladder
2*a*, 2*b*, 2*c*, 2*d*, and 2*e* bar
3*a* and 3*b* chain
4 tape
5 pipe
6 string
7 loop
8 ring
9 connector
10 loop
11 body bar
15 plate-shaped member
16 rope
20 training ladder
21 string

The invention claimed is:

1. A training ladder, comprising:

a first chain and a second chain arranged parallel to each other;

a plurality of strings arranged parallel to each other, one end of each of the plurality of strings being connected to the first chain, and another end of each of the plurality of strings being connected to the second chain; and a plurality of hollow bars, each being turnably disposed over each of the plurality of strings, wherein each of the bars is composed of a rigid body, and is arranged to have a play for absorbing a change of a joint direction of the bar and the chain at each of joint portions of the bars and the chains by turning the bar, and each of the strings is a ring-shaped string extending through the bar in a longitudinal direction of the bar, and also each end of the ring-shaped strings positioned at two ends of the bar is put into a ring constituting the first or second chain so that the string and the ring are linked with each other.

2. The training ladder according to claim 1, wherein each of the plurality of bars, positioned at an end of the training ladder, is marked.

3. The training ladder according to claim 1, wherein one cell surrounded by two of the plurality of bars and the first chain and the second chain is square with 50 cm on each side.

4. The training ladder according to claim 1, wherein one cell surrounded by two of the plurality of bars and the first chain and the second chain is square with 40 cm to 60 cm on each side.

5. The training ladder according to claim 1, wherein one of the plurality of bars is arranged at one end of each of the first chain and the second chain, another of the plurality of bars is arranged at another end of each of the first chain and the second chain, and others of the plurality of bars are arranged to be equally spaced between the one of the plurality of bars arranged at the one end and the another of the plurality of bars arranged at the another end.

* * * * *